United States Patent [19]

McKay, deceased et al.

[11] 4,080,896

[45] Mar. 28, 1978

[54] METHOD FOR HIGH SPEED APPLICATION OF PRINTING CODE INDICIA

[75] Inventors: James G. McKay, deceased, late of Skokie, Ill.; by Allen J. McKay, executor, Palatine, Ill.

[73] Assignee: Kiwi Coders Corporation, Chicago, Ill.

[21] Appl. No.: 770,005

[22] Filed: Feb. 18, 1977

Related U.S. Application Data

[62] Division of Ser. No. 571,906, Apr. 28, 1975, Pat. No. 4,047,879.

[51] Int. Cl.[2] ..... B41F 17/00

[52] U.S. Cl. ..... 101/426; 101/35

[58] Field of Search ..... 101/426, 35, 36, 41–44

[56] References Cited

U.S. PATENT DOCUMENTS

| | | | |
|---|---|---|---|
| 2,351,224 | 6/1944 | Nystrom | 101/36 X |
| 2,636,436 | 4/1953 | Mann | 101/35 C |
| 2,735,600 | 2/1956 | Hohl et al. | 101/35 |
| 2,787,950 | 4/1957 | Dorsch | 101/44 |
| 2,796,827 | 6/1957 | Vantlander | 101/44 |
| 3,359,891 | 12/1967 | Price, Jr. | 101/35 |
| 3,624,730 | 11/1971 | Gottscho | 101/35 |
| 3,685,442 | 8/1972 | Harwell, Jr. | 101/35 X |
| 3,738,260 | 6/1973 | Navi | 101/35 |
| 3,786,746 | 1/1974 | Roberts | 101/35 |
| 4,037,529 | 7/1977 | Delligatti | 101/35 |

*Primary Examiner*—E. H. Eickholt

*Attorney, Agent, or Firm*—Silverman & Cass, Ltd.

[57] ABSTRACT

A method for the high speed application of printing code indicia. The articles to be imprinted are carried by a conveyor consecutively past an imprinting zone wherein printing heads on an imprinting wheel intercept the article at an imprinting location. The articles are spaced uniformly a predetermined distance, the lateral movement of the articles is restricted through the imprinting zone, a positive force is applied to the tops of the articles to immobilize the articles at the same time the imprint is applied and the speed of the circumferential rotation of the imprinting wheel is correlated with the speed of the conveyor and the number of printing heads carried by the imprinting wheel.

8 Claims, 19 Drawing Figures

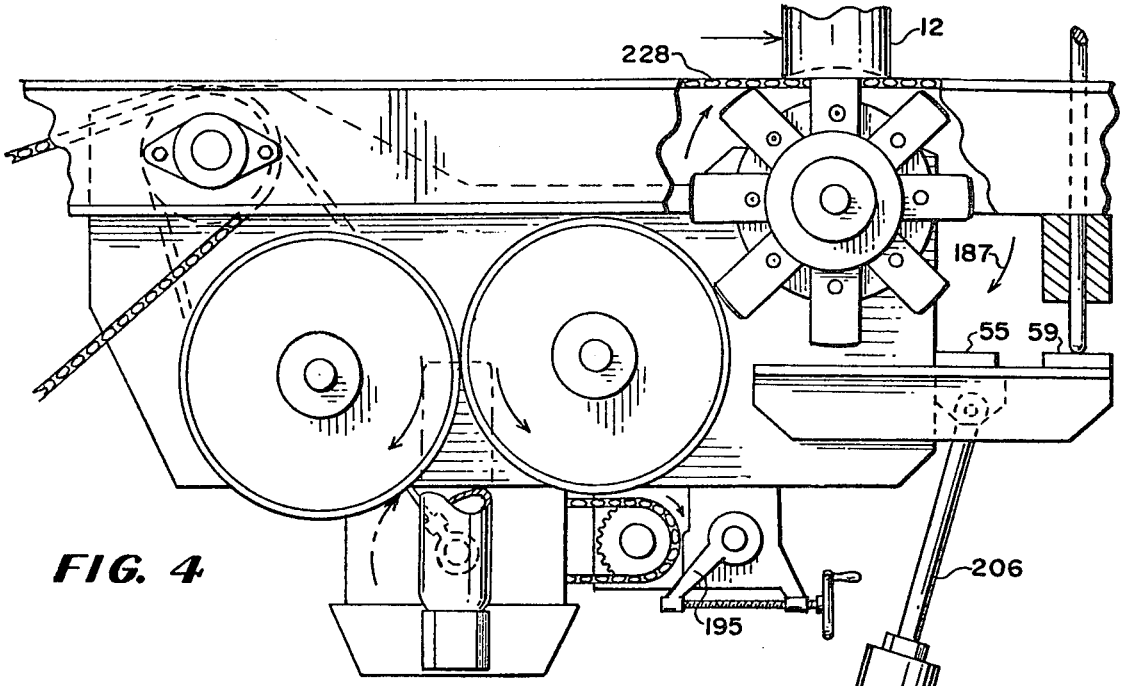
FIG. 4
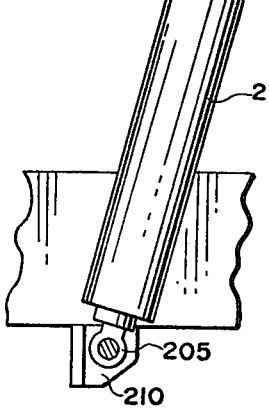
FIG. 5
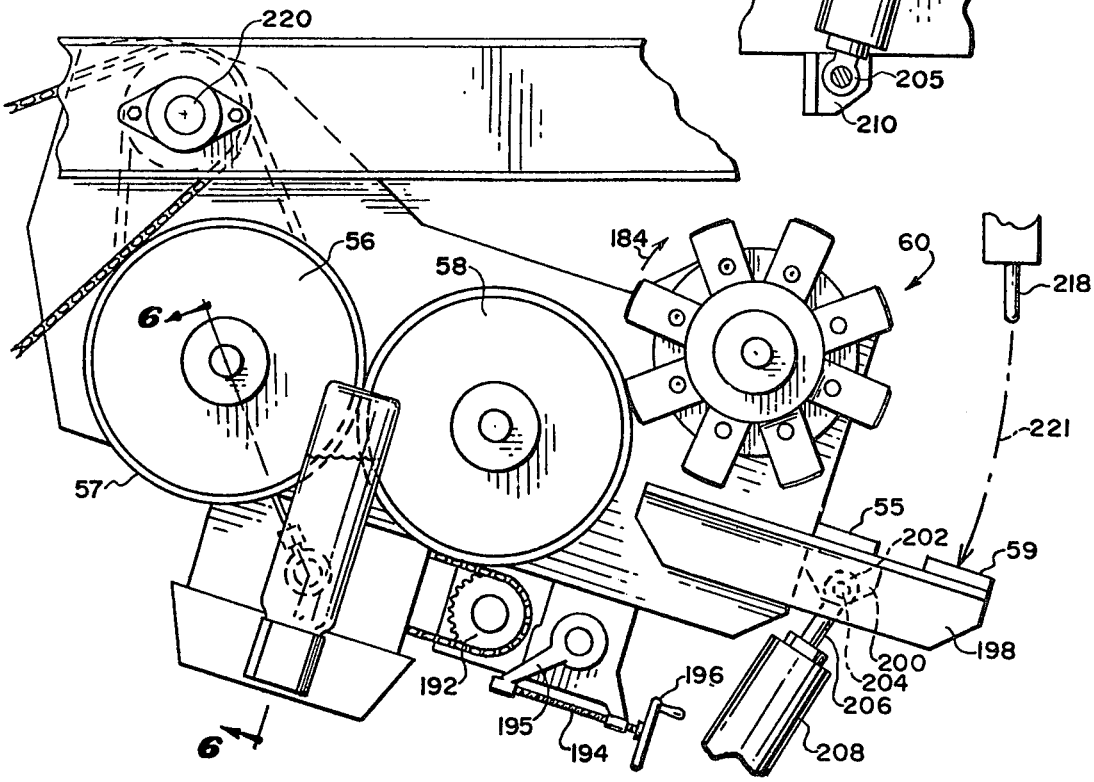

FIG. 9
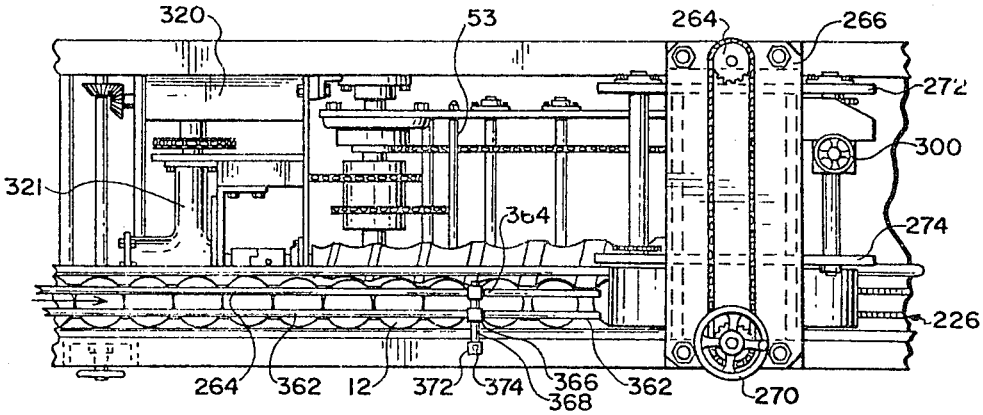
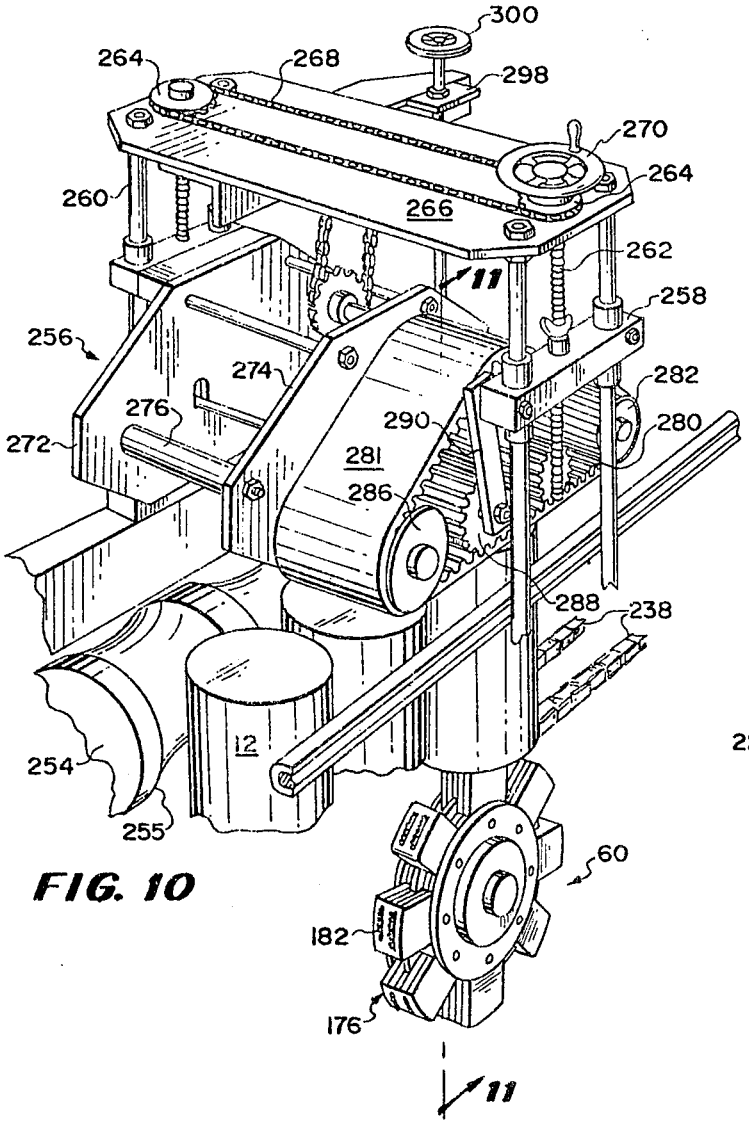
FIG. 10
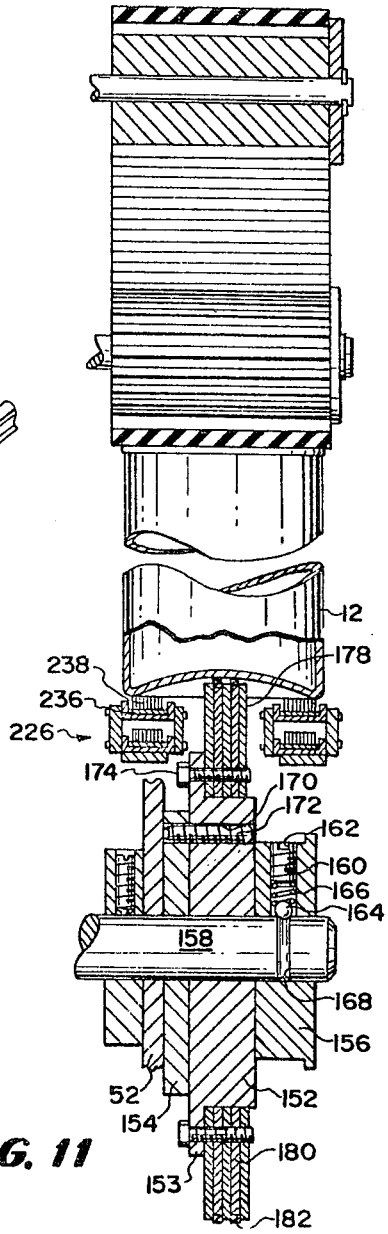
FIG. 11

FIG. 14
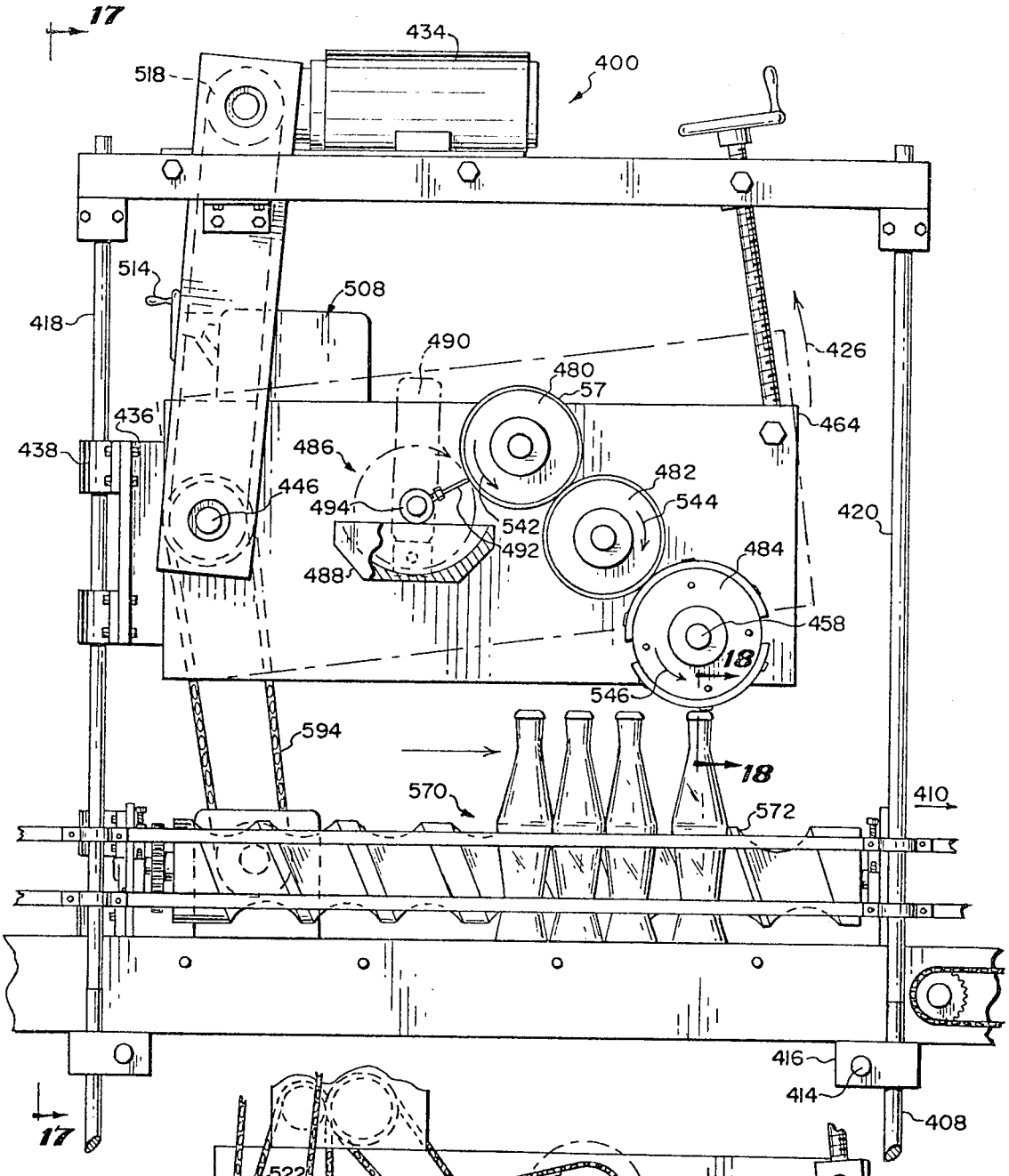
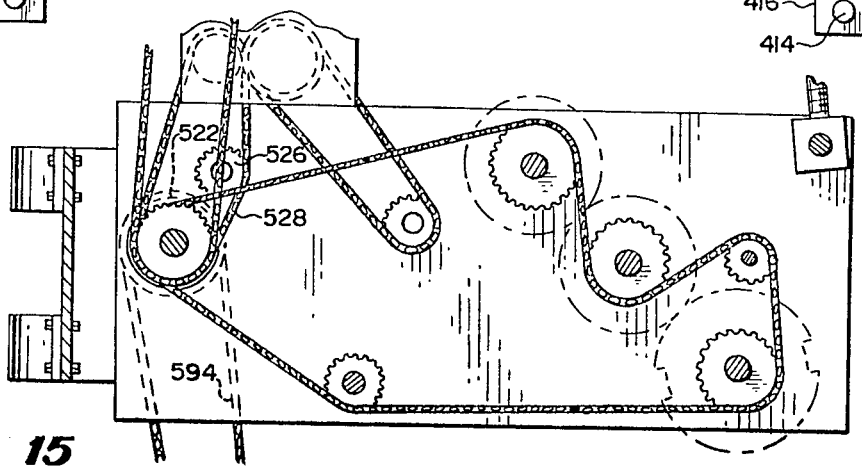
FIG. 15

METHOD FOR HIGH SPEED APPLICATION OF PRINTING CODE INDICIA

This application is a divisional application of Ser. No. 571,906, filed Apr. 28, 1975, and now U.S. Pat. No. 4,047,879.

BACKGROUND OF THE INVENTION

This invention relates generally to article coding machines for imprinting information upon articles traveling along the upper reach of a conveyor and more particularly is concerned with the provision of a coding machine for beverage containers such as cans and/or bottles which is capable of operating at a speed substantially greater than heretofore achieved yet with the maintenance of quality and the minimization of possible damage to either the containers and/or the immediate environment of the machine.

Coding or printing apparatus of the general type with which the invention is concerned applies an imprint at a predetermined location upon an article traveling along the reach of a conveyor as the article passes a printing location or station. Such apparatus is incorporated in article coding machines for applying such imprints to the underside of beverage cans and the caps of beverage bottles. However, to date, the speed of operation capable of being achieved by known coding machines is far less than the ability of the can and/or bottle feeding apparatus to deliver such containers to the coding machine. Increased speed of operation without resultant damage to the container and/or the environment of the machine has been a long-felt need of the packaging industry.

In addition to the desirability of high-speed operation, it is essential that the imprints applied to the containers be clear and properly located. As well, it is desirable that the mechanisms utilized be capable of easily being inspected, maintained and otherwise serviced without a substantial down time of the coding machine. Many coding machines incorporate imprinting apparatus of the rotary type which is characterized by the provision of a train of rotary members arranged so that their circumferential surfaces engage momentarily so that ink applied to one surface can be transferred and reapplied to the type face of a rotary printing head which in turn is placed in intercepting relationship with the surface of the article to be imprinted. In addition to the difficulties encountered with known coding machines in the interchange of type faces, cleaning and other routine maintenance operations, high-speed operation has resulted in the scattering of ink particles from the respective circumferential surfaces with increased occurrence as the speed of operation is increased. This is particularly encountered where liquid ink is utilized. The use of liquid ink is desired since it is effectively used upon wet surfaces commonly encountered where the articles are metal containers filled with a cool fluid so that condensation occurs, or containers having release coatings thereupon resulting from their process of manufacture. Powdered ink used in some high speed marking processes has a materially reduced effectiveness upon said containers. Substantial difficulties have been encountered in achieving proper registration or synchronization at the imprinting station, in passing the containers to and from the printing station and, as well, adjusting the printing heads so that the imprinted indicia will not be blurred or otherwise unsatisfactory such as partially printed, faint or improperly synchronized so as to be improperly distributed on the imprinted surface.

Although the term "high speed" is a relative term and of course differs depending upon the specific articles to be imprinted. High speed in the beverage can operations involves as many as 2,000 articles per minutes and as many as 750 articles per minute where bottle beverage containers are considered. Operation at such "high speed" has been considered impossible, particularly where rotary-type imprinting apparatus is utilized. Coding machines which operate to apply indicia by way of electrostatic processes and do not require actual contact with the article surface are available, and do operate at relatively high speeds. However, the appearance of the imprint and the amount of information capable of being imprinted is considerably minimized and of minimum quality, particularly when utlized for coding wet or release coated surfaces. In addition, the cost of such equipment as well as the cost of operation of such equipment is considerably greater than machines which utilize the rotary type imprinting apparatus.

There are occasions when a certain group of articles traveling along the converyor are not to be imprinted although such group travels in a line containing groups of articles which are to be coded. It would be desirable to render the imprinting means inoperative upon only the certain group and yet return the imprinting means to its operative condition for imprinting of the groups of articles whose coding is desired. This can be accomplished if the imprinting means can be displaced from its imprinting condition and then returned to its imprinting condition with retention of registration.

Accordingly, it is the intention of the invention to provide a high speed article coding machine which is capable of operation at an adjustable speed up to its maximum by virtue of improved sycnhronizing, positioning, and inking and imprinting apparatus.

SUMMARY OF THE INVENTION

A high speed article coded machine for application of indicia consecutively upon articles traveling in a line along the upper reach of a conveyor to an imprinting location, said coding machine comprising a framework for supporting the operating components of said machine; conveyor means for moving the articles to the imprinting location, feed means for spacing said articles as they travel along said conveyor reach to present the articles to the imprinting location properly registered for application of the imprint thereupon; hold-down means arranged above the reach of the conveyor at the imprinting zone whereby to prevent relative movement between the imprinting means and the article being imprinted during its imprinting; an inking and imprinting assembly fulcrum mounted as a unit upon said framework and disposed to position article imprinting means carried thereby in an intercepting relationship with consecutive articles at an imprinting location drive means, including a single electric drive motor, for operating the operating components of the machine at the same speed and means for selectively raising and lowering the inking and imprinting assembly as a unit from its intercepting disposition relative to the articles to a nonintercepting condition thereof while continuing the operation of the machine.

The inking and imprinting assembly includes a variable speed ink applicator arrangement whereby to control the quantity of ink applied from a reservoir to an inking wheel of the imprinting assembly; and, also includes means whereby the circumferential speed of each of the operating wheel members of said imprinting assembly differs one relative to the other so that the location at which one engages the other incrementally is varied with each revolution thereof, again to control the application and transfer of ink to the imprinting means of said assembly.

Another important aspect of the invention is that quick coupling means are provided upon each of the wheel members comprising the inking and imprinting assembly to permit their quick removal and replacement.

The machine also can be provided with gap and jam control devices to monitor the flow of articles through the machine to assure that the operation of the machine only occurs particularly at high speeds when there is a continuous feed of articles to the feed means and that the machine is stopped when jams are detected downstream of the delivery end of the machine. Adjustable time delay means are provided for each of the control devices so that the effect of said control devices in stopping or starting the machine is delayed within controlled limits.

BRIEF DESCRIPTION OF THE DRAWINGS

FIG. 4 is an enlarged fragmentary detail of the coding machine illustrated in FIG. 1 and illustrating the rotary imprinting assembly used therein in operative condition;

FIG. 5 is a view similar to that of FIG. 4 but with the rotary imprinting assembly in its nonimprinting condition.

FIG. 9 is a top plan fragmentary view of the coding machine illustrated in FIG. 1;

FIG. 10 is a fragmentary perspective view illustrating the mechanisms at the imprinting station of the coding machine illustrated in FIG. 1;

FIG. 11 is an enlarged sectional detail taken along lines 11—11 of FIG. 10 and viewed in the direction indicated;

FIG. 14 is an elevational view of a coding machine constructed in accordance with a modified form of the invention and particularly suitable for imprinting bottle caps of beverage bottles;

FIG. 15 is a fragmentary detail of the coding machine of FIG. 14 with portions deleted to illustrate interior detail;

DESCRIPTION OF THE PREFERRED EMBODIMENTS

Figure 1:
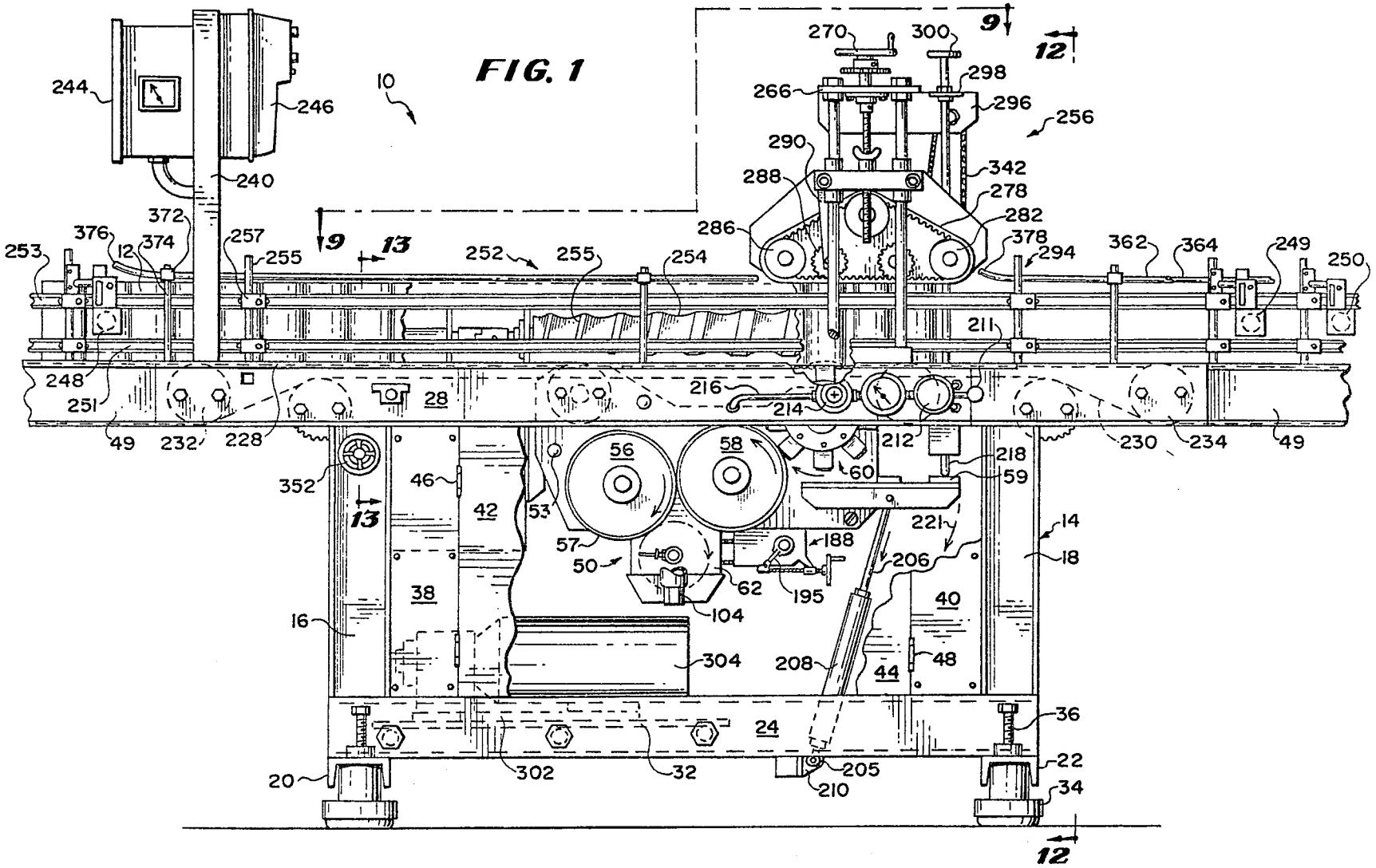
FIG. 1 is a side elevational view of an article coding machine constructed in accordance with the invention with portions deleted to show interior detail.
Figure 2:
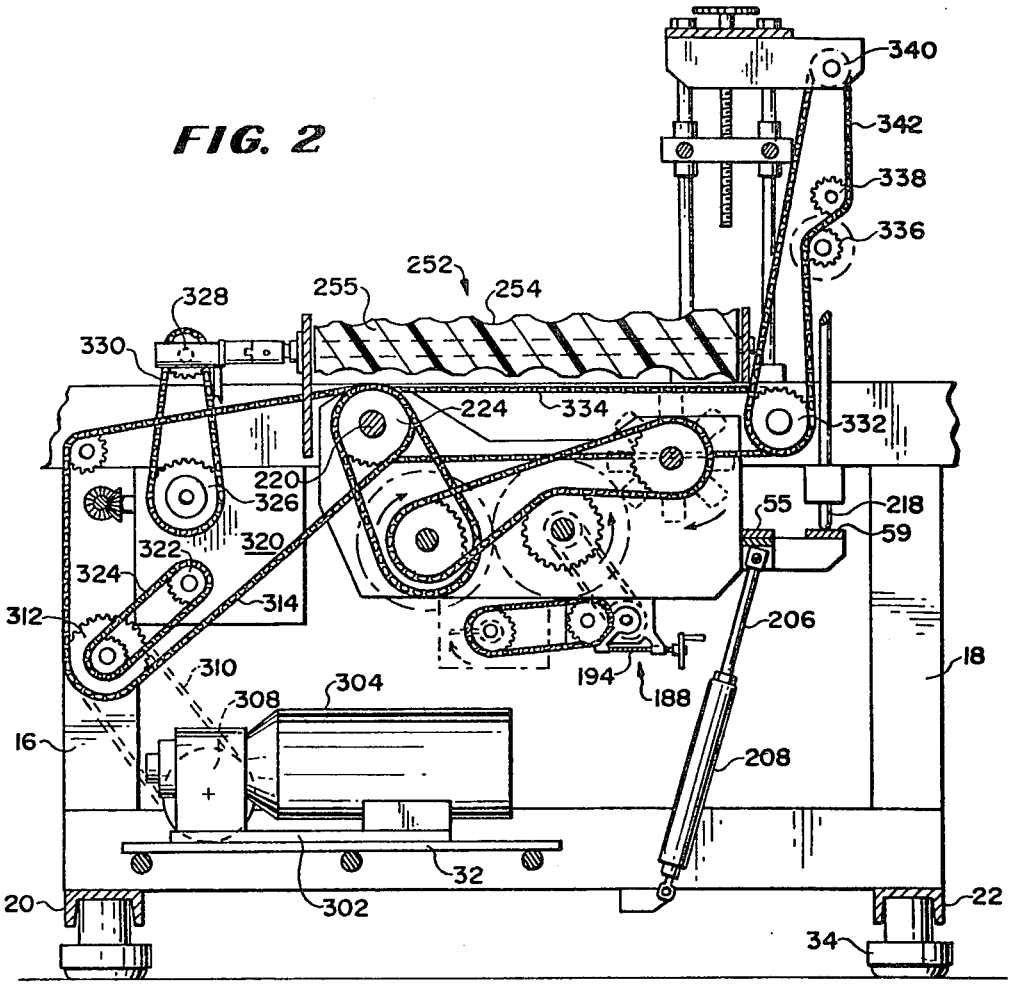
FIG. 2 is a fragmentary elevational view of the coding machine illustrated in FIG. 1 with portions removed to show interior detail and specifically the driving connections for operating the machine.
Figure 3:
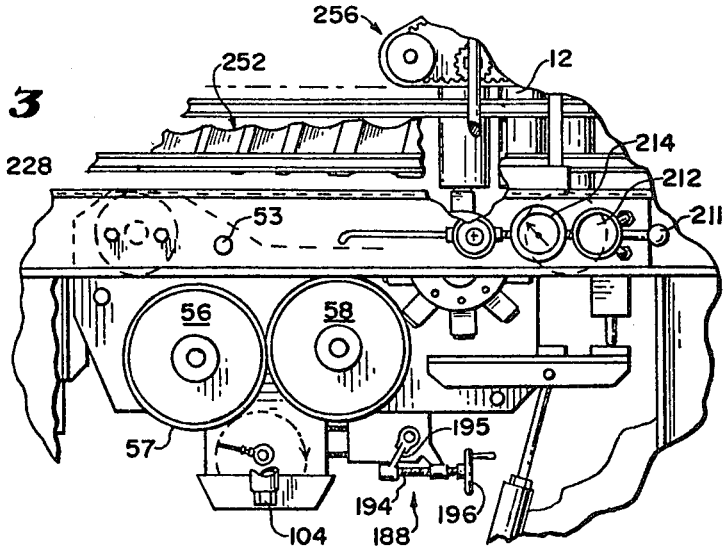
FIG. 3 is a fragmentary enlarged detail of the coding machine illustrated in FIG. 1.
Figure 6:
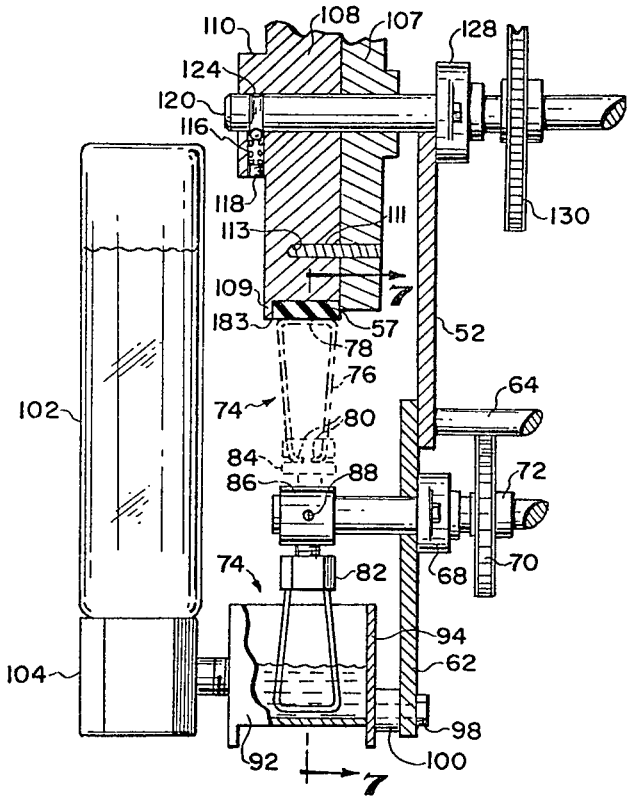
FIG. 6 is a fragmentary sectional view taken through lines 6—6 of FIG. 5 and viewed in the direction indicated.
Figure 7:
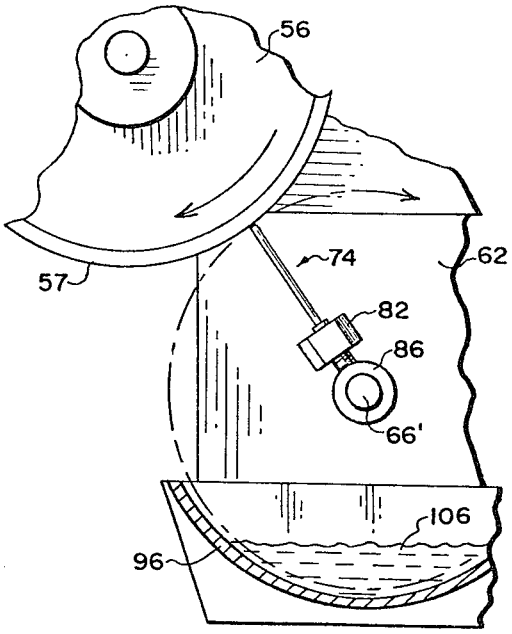
FIG. 7 is an enlarged fragmentary sectional view taken along lines 7—7 of FIG. 6 and viewed in the direction indicated.
Figure 8:
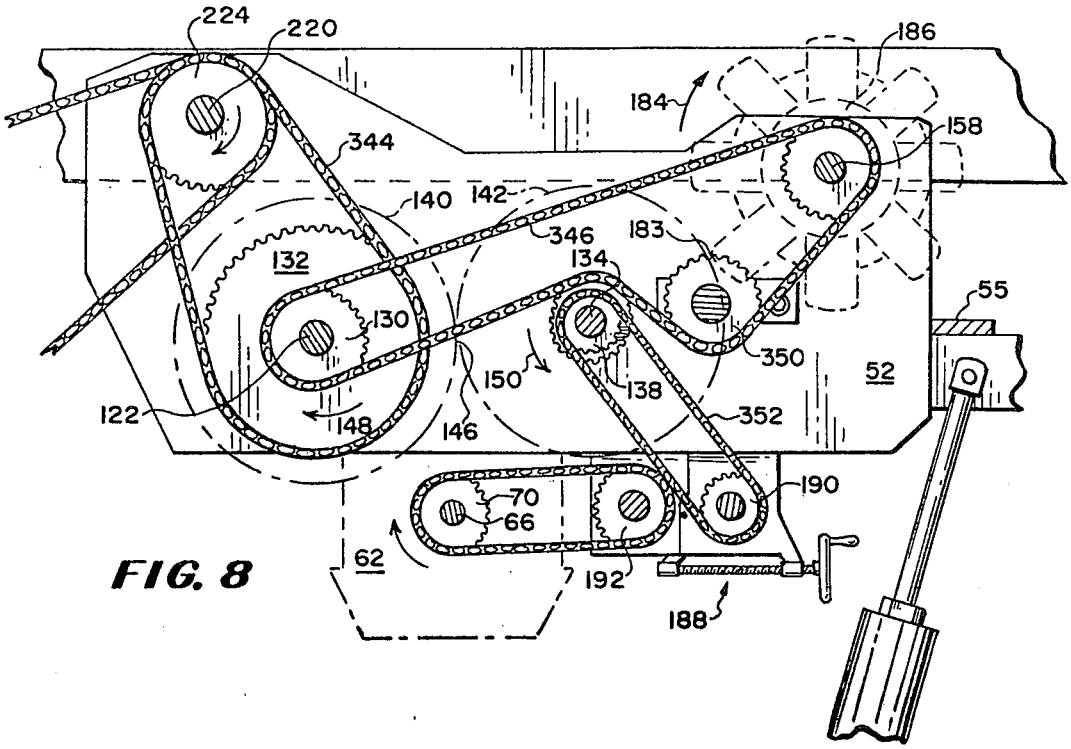
FIG. 8 is an enlarged detail of the coding machine as illustrated in FIG. 2.
Figure 12:
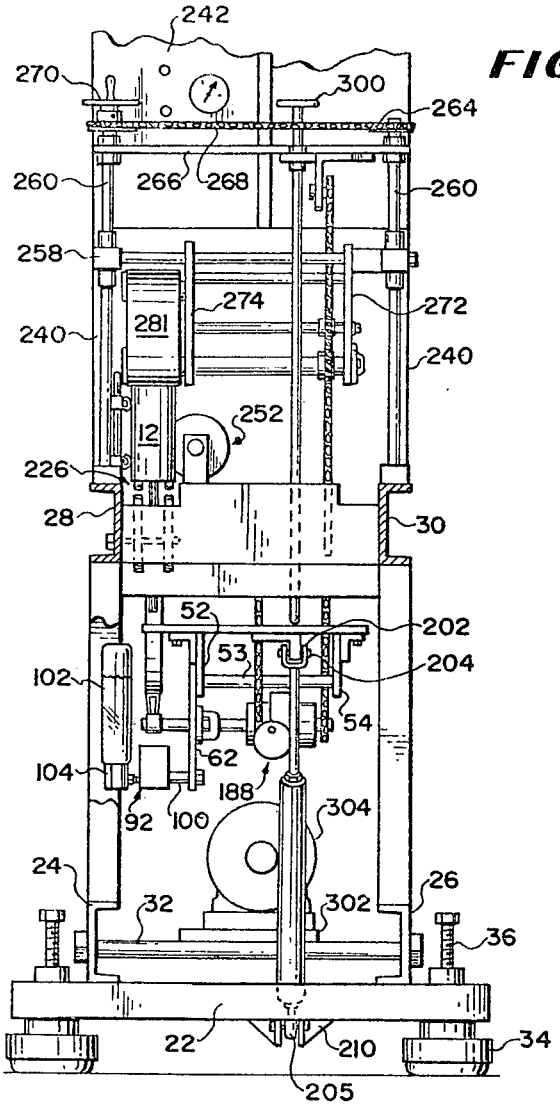
FIG. 12 is an elevational view of the output end of the coding machine illustrated in FIG. 1.
Figure 13:
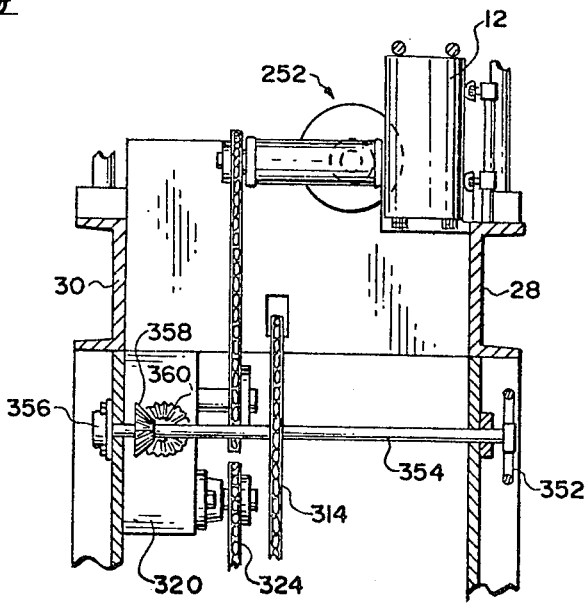
FIG. 13 is a fragmentary section taken along lines 13—13 of FIG. 1 and viewed in the indicated direction.
Figure 16:
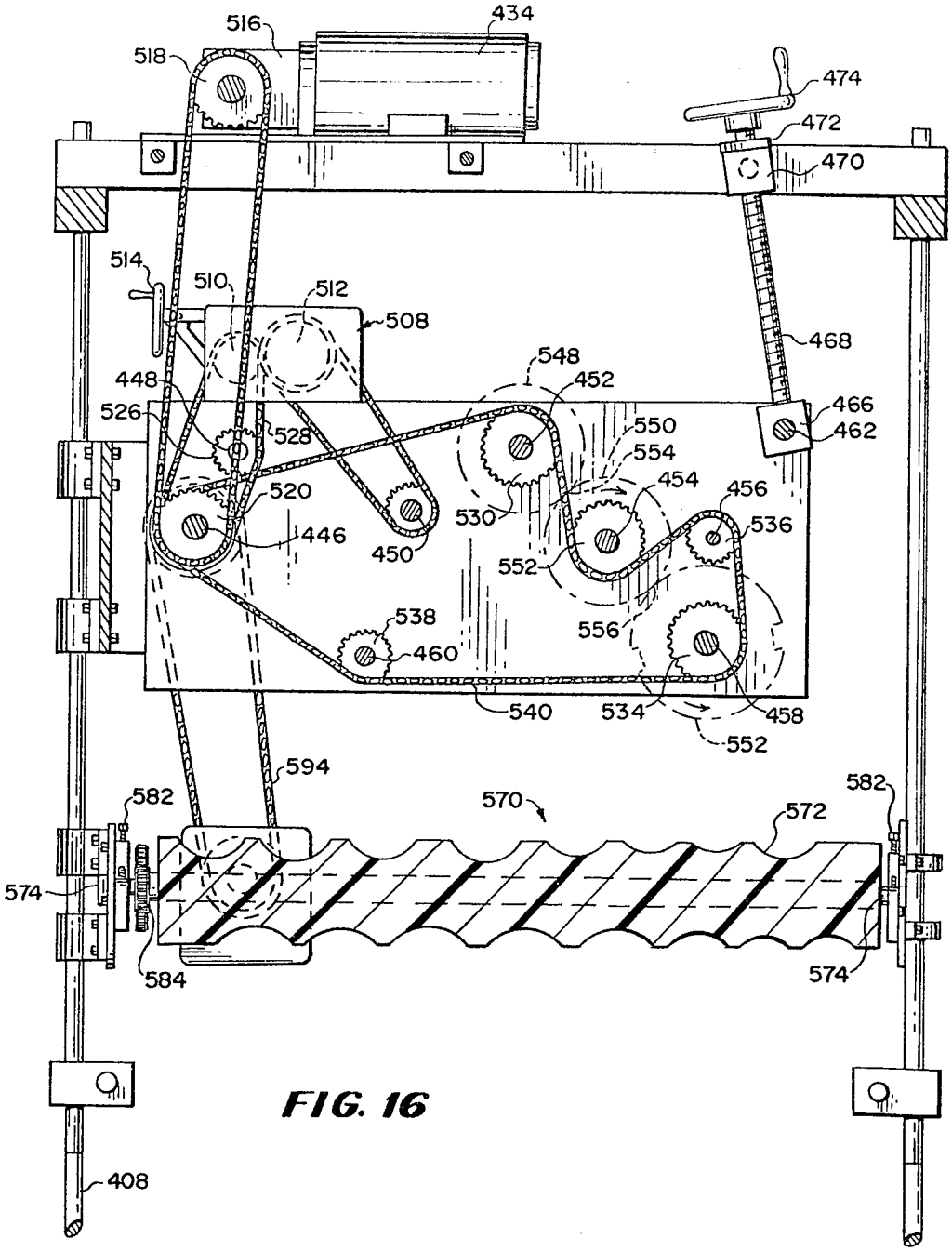
FIG. 16 is a similar view to that of FIG. 14 but with portions removed to illustrate interior details.
Figure 17:
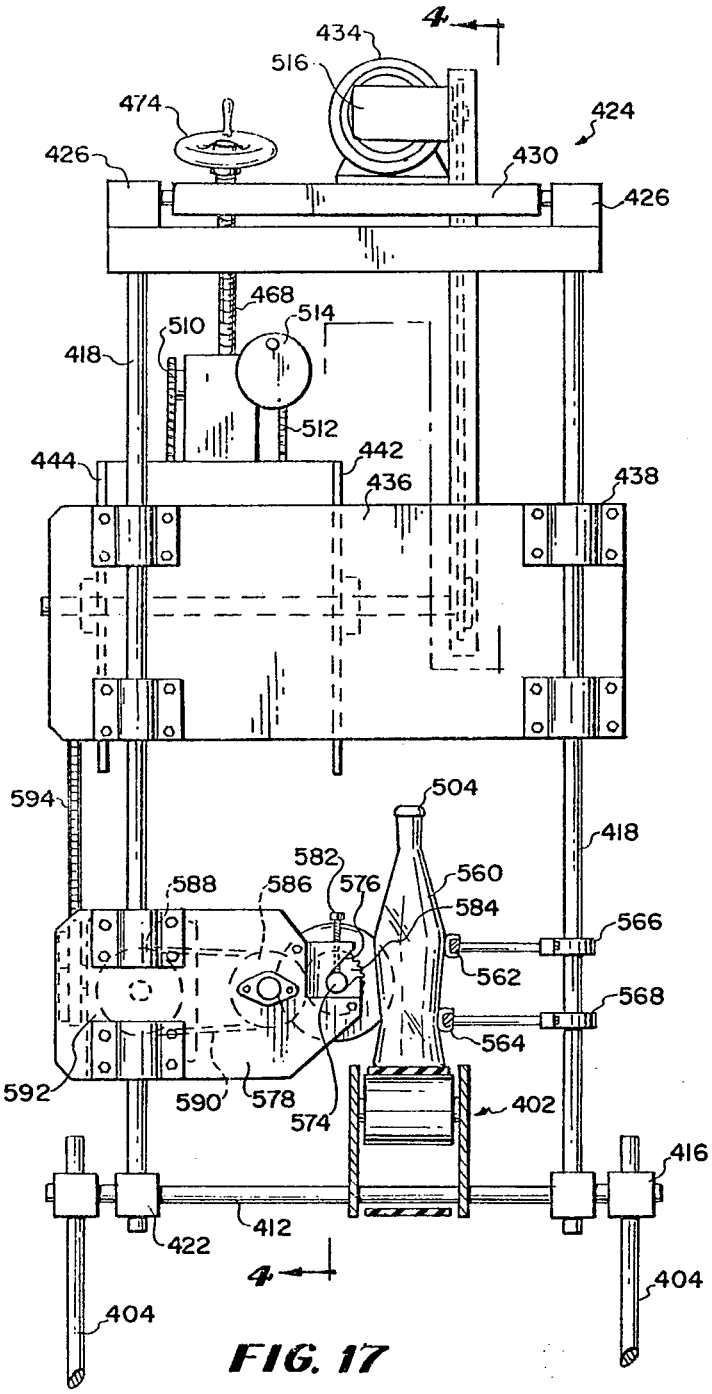
FIG. 17 is a sectional view taken along lines 17—17 of FIG. 14 and viewed in the direction indicated.
Figure 18A:
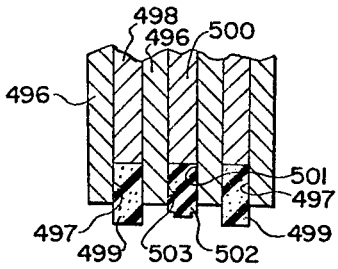
FIGS. 18 and 18A are enlarged sectional details taken along lines 18—18 of FIG. 14 and viewed in the direction indicated.
Figure 18:
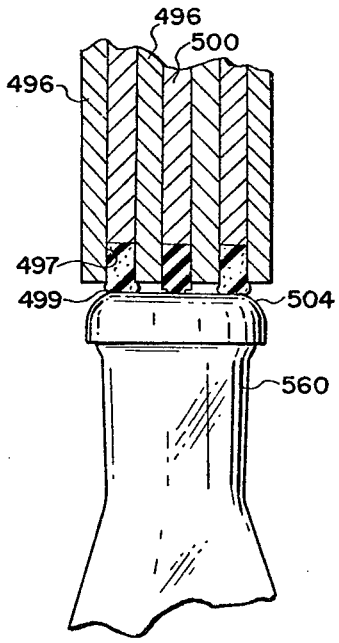

The embodiments of the invention shall be described as represented by coding machines intended for operation upon beverage containers such as cans or bottles, that is the bottle caps thereof. One machine to be described is intended for operation upon cans and the other is operative primarily upon the bottles. The can coding machine is capable of a maximum speed of operation upon 2000 cans per minute while the coding machine primarily intended for bottle operation is capable of applying clear indicia imprints to capped bottles traveling at a speed of up to 750 bottles per minute.

While there are differences between the two types of coding machines, certain common elements shall be described. These include a rotary inking and imprinting assembly which is fulcrum mounted and driven so that it is capable of being pivoted into and out from intercepting condition relative to the articles being imprinted either for fine adjustment of the position of the imprinting means relative said articles or to displace the assembly as a unit to establish access thereto for inspection, repair and/or replacement of components; or to bypass the imprinting means if desired without stopping the machine. Another common component of both machines comprise worm feed means arranged for spacing the individual articles properly as they travel along the conveyor and feeding the same to the imprinting zone so that the imprint can be applied thereto at an imprinting location within said imprinting zone. Means also are provided for applying a holding force to each of the articles at the imprinting zone during the imprinting, said articles being prevented from being dislodged by the contact of the printing means therewith. The holding force may be applied to the articles as they are being fed to the imprinting location by the worm feed means and may be continued until the imprinted articles leave a location spaced downstream from the imprinting zone so as to avoid backup of articles at the imprinting zone.

The can coding machine and the bottle coding machine are driven by a single electric motor and sprocket chain arrangements looped over sprocket gears for driving each of the operating components of the machines. All operating components of the machines are driven at the same speed but for the variable drive applied to the ink applicator supplying the inking and imprinting assembly with printing ink. The applicator is coupled to the drive means for the machine by way of a reduction gear assembly capable of operating the applicator at a speed from zero to the maximum speed of the said inking and imprinting assembly selectively to control the quantity of ink applied to the inking and imprinting assembly.

The inking and imprinting assembly includes a train of rotary wheel members circumferentially engaged tangentially one with the other, each of said wheel members being driven at the same axial speed (R.P.M.) but having a different circumferential speed of rotation one relative to the other better to control the application of ink from one of said wheel members to the other.

The can coding machine particularly is provided with a pneumatically operated raising and lowering mechanism so that the inking and imprinting assembly as a unit may be pivoted about its fulcrum mounting to displace the imprinting means carried thereby from intercepting condition relative to the articles being imprinted whereby to enable access easily to be gained thereto enabling repair, maintenance and/or replacement of components or to bypass the imprinting means without stopping of the machine or interference with the articles passing along the conveyor reach. The can coding machine also is provided with a hold-down means arranged above the conveyor reach and capable of applying a positive pull upon the articles as they enter and leave the imprinting zone thereby to prevent jamming of the containers at the output of the coding machine, backup of said containers thereby to prevent engagement of same with the blade of the worm feed means which could result in fracture of the containers and spillage of their contents. A positive pressure is applied to the container while imprinting is effected.

The hold-down means is vertically adjustable selectively so that the machine is versatile for use on different height containers.

The high speed bottle cap coding machine, according to the invention, is arranged to apply an imprint to the tops of bottle caps of successive beverage bottles traveling in a line along the upper reach of a conveyor. The article inking and imprinting assembly is fulcrum mounted and driven but is disposed above the reach of the conveyor rather than below the reach of the conveyor as in the can coding machine. Accordingly, the various operating components of the inking and imprinting assembly carried by the bottle coding machine are accessible, and therefor the pneumatic raising and lowering means is not required. However, means for incrementally adjusting the position of the imprinting means carried by the inking and imprinting assembly relative to the surfaces of the bottle caps being imprinted are provided. Such incremental adjustment means preferably take the form of a handwheel operated screw-threaded rod member bearing against a plate which is mounted to the assembly at a location spaced from the fulcrum mounting of said unit so as to adjust the position of the uppermost extent of the pivotal movement of said unit. The bottle cap coding machine further is provided with a removable worm feed member so that one feed member can be replaced with another, different worm feed member for operation upon different size bottles. The bottle cap coding machine also is capable of being installed for use with a pre-existing conveyor system using a framework capable of installation therein.

The description of the preferred embodiments of the invention shall refer to the machine illustrated in FIGS. 1 through 13 as the can coding machine while the invention as embodied in the bottle coding machine is illustrated in FIGS. 14 - 17 inclusive.

Referring first to FIG. 1, an article coding machine embodying the invention is designated generally by reference character 10 and is intended for imprinting code indicia upon beverage containers such as the familiar beer can in which one or both ends of the container is either flat or concave. The coding machine 10 illustrated herein is intended to apply code indicia to the concave bottom surface of the containers 12.

The can coding machine 10 is a self-contained unit, including a generally rectangular supporting framework 14. Two pair of vertically arranged channeled beams 16 and 18 are retained in spaced assembly by cross braces 20 and 22, and are spaced laterally by front and rear braces 24 and 26. Each brace is formed of channeled structural steel stock and all are assembled secured respectively by welding. The top of the framework 14 is defined by a pair of elongate channeled steel beams 28 and 30 preferably secured to the upper ends of beams 16 and 18 respectively by welding. A bridging plate 32 is secured between beams 24 and 26, said plate serving a bracing function as well as a support for an electric motor to be described hereinafter.

The framework 14 is supported upon adjustable leveling pads 34 which are secured to the cross braces 20 and 22 by bolts 36. A pair of panels 38 and 40 are fastened to beams 16 and 18, as well as to beam 28. Panel doors 42 and 44 are secured pivotally to the panels 38 and 40 respectively by hinges 46 and 48. Accordingly, the inking and imprinting assembly of the machine 10 is shielded while the machine is operating and is accessible when inspection, repair, maintenance or other activity is to be performed thereupon. The machine 10 is installed into an existing production line represented by the beams 49 on the right and left ends of the machine 10 as shown in FIG. 1.

The inking and imprinting assembly, designated generally by reference character 50 includes a pair of vertically oriented, spaced supporting plates 52 and 54 retained in spaced assembly by means of suitable spacers 53 and the respective shafts which are journaled in bearing block means carried by the plates 52 and 54. The assembly 50 as a unit is mounted within the open boxlike enclosure defined by the framework 14.

The operating components of the inking and imprinting assembly 50 comprise a train of rotary wheels mounted for rotation upon shafts supported by the plates 52 and 54, the rotational axes of the shafts being parallel. These rotary members include an inking wheel 56, a transfer wheel 58 and a printing wheel 60. The inking wheel 56 and transfer wheel 58 each carry an inking ring 57 constructed in accordance with the teachings of my copending application, Ser. No. 477,654 filed June 10, 1974, so as to define an ink absorbant surface surrounded by an ink impervious shield as taught in said application. The rings 57 are engaged frictionally upon the wheels 56 and 58 and can be removed and replaced with like members with ease when worn or perhaps during downtime of the machine 10.

A depending plate 62 is secured to plates 52 and 54 by horizontal bar 64, said plate 62 supports the ink reservoir and ink applicator which supplies printing ink to the inking wheel 56. Plate carries a shaft 66 journaled in a bearing assembly 68. A sprocket gear 70 having a hub 72 is mounted on the shaft 66 between the plates 52 and 54, the shaft 66 having a stub portion 66' extending outward of plate 52 for carrying the ink applicator, as will be described.

The ink applicator 74 comprises a U-shaped member having springlike arms 76 connected by a generally straight bridging portion 78. The free ends 80 of applicator arms 76 have facing bends which are spreadable for mounting in suitable oppositely opening sockets 84 formed in a holder 82. A collar 86 is mounted to the stub portion 66' of shaft 66 and secured thereupon by setscrews 88. The applicator holder 82 is coupled to the collar 86 by threaded portion 90.

An open-topped ink bath 92 is formed of a pair of spaced sheet steel plates 94 bridged by an arcuate floor plate 96 preferably assembled by welding. The bath 92 is secured to the plate 62 by bolt 98 passed through spacer 100. The location of the bath 92 is selected so that the path circumscribed by the rotating bridge 78 of applicator 74 sweeps close to the floor 96 within bath 92 without scraping same, and intercepts the outer circumferential surface of inking ring 57 carried by inking wheel 56 tangentially at a point therealong.

The ink bath 92 is supplied with liquid ink 106 from reservoir bottle 102 filled with said ink coupled to the bath 92 by way of valve means 104. The bottle 102 is rotated about 180 degrees to enable gravity feed of ink to the bath while a predetermined level of ink is maintained within said bath 92. The type of liquid feed that is utilized advantageously herein, is commonly in use in bird feeders, for example. When the bottle 102 is empty or when the machine 10 is down, the bottle again is rotated again about 180 degrees and can be released from its seat to enable removal, repair and/or replacement thereof.

The inking wheel 56 and the transfer wheel 58 are substantially identical in construction. The wheel 56 is formed of two pieces, the mounting disc 107 which is secured substantially permanently to shaft 122 and the face plate 108 also formed as a disc but having a lesser diameter than mounting plate 107. The face plate 108 has an annular flange 109 of the same diameter as mounting plate 107. Plate 107 carries a mounting pin 111 arranged to extend outwardly normal to its surface and parallel to the axis of shaft 122. The face plate 108 carries a passageway 113 which is adapted to receive pin 111 therein when the face plate 108 is mounted properly upon shaft 122. The face plate 108 has a hub portion 110 coaxial therewith. The hub 110 has a through bore 112 normal to the axial bore 114 of the wheel 56. A coil spring 116 is seated within the bore 112 with a setscrew 118 closing off the outer open end of bore 112. A ball 120 is seated on spring 116 at the inner opening of the bore 112. The inking wheel 56 is supported upon shaft 122 which has a groove 124 formed therein at a predetermined location from its end 126. the wheel 56 is engaged slidably on shaft 122 and urged therealong until the ball 120 enters the groove 124 and is biased therein so as to retain the wheel 56 at a location where the circumferential surface of the inking ring 57 carried thereby is aligned with the applicator 74 as well as with the other wheels of the train. The disc 108 has a circumferential surface width sufficient to accommodate the inking ring 57 and is of a diameter sufficient to enable slidable engagement of the ring 57 upon said circumferential surface, retained in place by the mounting plate 107 and the annular flange 109 sandwiching same. Pin 111 is seated in passageway 113.

Removal of the wheel 56 from the shaft 122 is accomplished by the operator exerting a pulling force upon the face plate 108 away from the mounting plate 107 sufficient to overcome the bias of the spring 116 forcing the ball 120 from the groove 124. This spring-biased ball-plunger arrangement and location pins and sockets enable the inking wheel 56, the transfer wheel 58 and the printing wheel 60 to be easily demounted from their respective shafts as each is provided with such quick coupling means as said biased ball-plunger arrangement.

The shaft 122 is supported journalled in suitable bearings 128 mounted on plates 52 and 54 and carries sprocket gears 130 and 132 which can be formed as one piece with the gear 130 being diametrically smaller than gear 132. The transfer wheel 58 is mounted to shaft 134 and driven by sprocket gear 136 mounted to shaft 134. Shaft 134 also carries a smaller diameter gear 138 arranged between gear 136 and the plate 54. The shafts 122 and 134 parallel one relative to the other and are located so that the circumferential paths 140 and 142 of wheels 56 and 58 respectively tangentially intercept at a location 146 which may be termed a kiss. In machine 10, the inking wheel 56 is rotatable in a clockwise direction as indicated by the arrow 148 and the transfer wheel 58 is rotatable in a counterclockwise direction as indicated by arrow 150.

The printing wheel 60 of the inking and imprinting assembly 50 comprises a mounting disc 154 and a disc 152 which includes an integral annular flange 153 and a hub portion 156. The mounting disc 154 is secured to shaft 158 near the plate 52. The hub portion 156 is mounted to the shaft 158, and carries a passageway 160. Setscrew 162 is seated at the outer opening of the passageway 160 and a ball 164 is biased by spring 166 into the groove 168 carried by shaft 158 whereby to define a spring-biased ball-plunger arrangement identical to the arrangement carried by the inking and transfer wheels. Like said wheels 56 and 58, printing wheel 60 is firmly seated on its shaft 158 but can easily be removed therefrom when such action is desired. The disc 154 carries a passageway 170 formed therein and guide means in the form of mounting pin 172 is seated therein. Pin 172 is secured to plate 154 and extends outward therefrom with its axis parallel to the axis of shaft 158. The flange 153 of wheel 60 accommodates fastening means such as allen screw 174 by which the individual plural printing heads 176 are secured to the printing wheel 60.

Each printing head 176 comprises plural layers of plates 178 sandwiching type carrying plates 180 which have indicia bearing type font members 182 protruding from the sandwich. Eight printing heads 176 are secured to the printing wheel 60 so that they extend outward radially about the hub 156, the fonts 182 defining a circumferential path represented by path 184 when the wheel 60 is rotated. Eight heads 176 are selected to enable the printing wheel 60 to be operated at a relatively slow maximum speed of 250 R.P.M. yet provide 2000 imprints per minute. This materially reduces the likelihood that any ink will be thrown outwardly by centrifugal force as would be expected and undoubtedly encountered should a single rotary imprinting head be utilized at an R.P.M. for impression of as many as 2000 imprints per minute.

Prevention of ink-throw further is assured by the control of the amount of ink applied to the type-font as will be explained hereinafter. The shaft 158 is positioned so that the path 184 tangentially intersects the circumferential path 142 of the transfer wheel 58 at a kiss 183, and said path 184 also passes between the conveyor reaches at the imprinting location whereby to apply the imprint to the generally concave bottom surfaces of the containers 12.

The printing wheel 60 is rotated in a clockwise direction 187 by a sprocket gear 186 mounted to the shaft 158 between the plates 52 and 54, as will be described hereinafter.

A reduction gear assembly 188 is carried by plate 52 and has an input sprocket gear 190 and an output sprocket gear 192. An adjustment screw 194 controlling lever 195 operated by handwheel 196 is provided to adjust the reduction gear assembly 188 to reduce the output variably within a range from zero to its maximum of 250 R.P.M., the speed at which the operating components of inking and imprinting assembly 50 are operated.

The inking and imprinting assembly includes a pair of angle bars 198 secured respectively thereto and bridged by bracing bars 55 and 59. An angle bracket 200 is secured to the bracing bar 55 between its ends and a yoke 202 is coupled to one arm of the angle bracket 200 by bolt 204 to define a pivotal connection. The yoke 202 supports the free end of plunger 206 which is reciprocably movable within an air cylinder 208. The lower end of air cylinder 208 is coupled pivotally to yoke 205 between brackets 210 which are secured to the beam 24.

The inking and imprinting assembly 50 is located below the conveyor reach and is mounted pivotally to shaft 220 which in turn is suitably journaled in bearing blocks secured to beams 28 and 30. Sprocket gear 224 is mounted to the shaft 220 and is adapted to be coupled to the principal drive means of the machine 10.

The plunger 206 is reciprocable between an extended condition and a condition where it is withdrawn into the cylinder 208. This reciprocation is controlled by air cylinder controls 212 operated by lever 211. A gauge 214 is provided for monitoring the air pressure in the line 216 leading to the air cylinder 208. Pressure is applied or relieved selectively by operating lever 211 thereby to raise or to lower the plunger 206 along a path indicated by the arrow 221 pivoting the assembly 50 about its mounting upon shaft 220. A height adjustable stop pin 218 is provided for limiting the upward thrust of brace 59 so as to adjust the height at which the circumferential path 184 extends between the upper reach 228 at the imprinting location.

A pair of endless conveyor chains 226 are arranged spaced side by side along the beam 28 and define upper reach 228 and a return or lower reach 230. The conveyor chains 226 are supported at opposite ends of the machine 10 and by sprocket wheels 232 and 234. The containers 12 are carried in a line upon the upper reach 228. A thin metal strip 236 can be disposed within the conveyor 226 below the links 238 thereof functioning as a wear strip therefor.

Vertically arranged support posts 240 are mounted to beams 28 and 30 of framework 14 and support a plate 242 which in turn supports the electrical controls for the operation of the machine 10. Box 244 contains sensing controls which shall be described hereinafter while box 246 contains the speed controls by which the speed of the machine can be adjusted between rest to its maximum of 2,000 cans per minute. Both the sensing controls per se and the speed controls per se are known and available commercially.

The sensing controls comprise a gap sensor 248 in the form of a solid state proximity detector and a pair of jam sensors 249 and 250, each of which comprise solid state detectors. The gap sensor 248 is positioned at a location close to the input end of the machine 10. The jam sensors 249 and 250 are mounted in tandem at a position spaced from the delivery or output end of the machine. The said sensors are coupled to suitable adjustable time delay pairs in the form of suitable relays enclosed within box 244. One of each pair provides a given adjustable time delay for effecting the action resulting when a sensor operates and the other of the pair functions to provide an adjustable time delay when the sensor resumes its pre-operative state. So long as their are containers sensed by the gap sensor 248, the machine 10 will operate. If the sensor 248 does not sense the presence of a container 12, then the sensor 248 operates the relays in box 244 to override the speed controls in box 246 and the coding machine 10 is stopped. Once the presence of containers 12 again are sensed and through the relays of the time delays in box 244, the machine 10 again is started.

More than one gap sensor 248 can be utilized and at the high speeds of operation of the machine 10, say from 1000 - 2000 cans per minute, it is preferable to provide several several gap sensors each spaced at predetermined locations upstream from the input end of machine 10. One of these gap sensors operates when containers are sensed to cause the machine 10 to operate, say at a low speed less than a selected running speed while sensor 248 is set to operate the machine 10 at another or second speed. In order to have a continuous line feed which is necessary for high speed operation, the machine 10 should not operate at that high speed unless there is a predetermined number of articles in line being fed to the input end of the machine. The number of articles required is gauged by length of the continuous line of articles and hence the sensor that governs high speed operation, is positioned at a location spaced from the input of the machine 10 approximating the desired length of the line of articles required. The sensor 248 operates to turn on the machine when a container is sensed. Unless the distant sensor also senses a container and operates at the same time as sensor 248, the machine will not operate at full speed. A third sensor of the same type as sensor 248 is positioned between the last-mentioned two sensors and operates with sensor 248 to operate the machine at the low speed. In this manner, repeated or intermittent start up and stop momentarily after start is avoided, and, as well the machine 10 can be started and stopped gradually.

Worm feed means 252 are provided for spacing the containers 12 as they travel along the upper reach 228 of the conveyor 226 and feeding the containers in such spaced array to the imprinting zone of machine 10 in condition to receive the imprint. The worm feed means 252 includes a rotatable screw 254 of generally cylindrical configuration carying a helical groove 255 of variable pitch along the length of said screw. The principals of operation of the worm feed means 252 can be ascertained by reference to U.S. Pat. No. 3,035,515 granted May 22, 1962 to J. G. McKay, the feed operating in this instance to space the containers 12 on three inch centers for proper imprinting relation to the printing heads at the imprinting location.

A pair of guide rails 251 and 253 are arranged adjacent the reach 228 along the length of the machine 10. The rails are mounted upon vertically oriented posts 255 by clamp members 257. The guide rails 251 and 253 serve to retain the containers 12 upon the conveyor reach and bring the containers into engagement with the worm feed screw 254.

A pair of top guide bars 362 and 364 are provided horizontally oriented above the reach 228 along the length of the machine 10 except for the imprinting zone. The bars are parallel and are mounted by clamp blocks 366 upon horizontal cross bars 368. The cross bars 368 are secured at a predetermined height spaced from the reach 228 by mounting clamps 372 secured to vertical standards 374. The leading edges 376,378 of the bars are upwardly bent to facilitate the passage therepast of the containers 12. The said leading ends of bars 376 and 378 extend from a given distance from the input of the machine to the hold-down assembly. A second group of identical bars have their leading ends adjacent the delivery end of the hold-down means and extends along the line conveyor a given distance. The purpose of these horizontal top guides is to prevent the containers from bouncing or climbing upon each other during passage along the conveyor due to the nature of the upper ends of the containers.

The screw 254 is positioned with its axis of rotation spaced above the upper reach of the conveyor 226 and is spaced laterally from the path of travel of the containers along the upper reach 228 of the conveyor 226 and parallel therewith. The worm feed screw extends laterally along the conveyor 226 upstream from the imprinting zone and extends into the imprinting zone to the imprinting location. The leading edge of the screw 254 engages the container as it passes same and the container is caused to follow the groove and is caused thereby to momentarily travel at a slower speed than the conveyor at that leading edge of the screw 254. As the pitch of the helical groove 255 varies along the length of the screw 254, the speed of travel of the container is caused gradually to increase along the length of the groove until, as the container has reached its desired spacing for arrival at the imprinting zone. When proper spacing has been reached, the container is traveling at a speed equal to the linear speed of the conveyor.

At this point the hold-down belt of hold-down means assumes at least partial control of the movement of the container for speed and register. The screw feed then functions as a guide for taking the containers through the imprinting zone past the imprinting location. Generally, the helical groove of the worm feed screw has effected the desired spacing of the containers just prior to entry of the containers to the hold-down means. It is the function of both the remaining portion of the worm feed screw and the hold-down means to maintain that spacing and registry to the imprinting zone.

The hold-down means which is provided for applying a positive holding pressure to the tops of the containers 12 at the imprinting location so that they are not dislodged by the imprinting procedure comprises hold-down assembly 256 supported across the top of the machine 10 above the upper reach 228 of the conveyor 226. A pair of support bars 258 for said hold-down assembly 256 are mounted for slidable movement together along vertically oriented parallel bar pairs 260, each pair 260 being mounted on opposite side beams 28 and 30 of the machine 10. Threaded shafts 262 are passed through suitably threaded openings in the support bars 258. Sprocket gears 264 are secured to the ends of members 262 on the outside of bridging plate 266. A sprocket chain 268 couples the gears 264 so that rotation of one rotates the other conjointly. One of the gears 264 has a hand wheel 270 secured thereto. Rotation of hand wheel 270 rotates gears 264 together causing the support bars 258 with the hold-down assembly 256 supported thereupon, to be selectively raised and lowered as a unit.

The hold-down assembly 256 includes a pair of spaced support plates 272 and 274 bridged by spacer bars 276 secured therebetween. The enclosure defined between plates 272 and 274 contains the drive means provided for operating the hold-down assembly 256.

The hold-down assembly 256 includes an endless belt 278 having an inner serrated surface 280 and an outer flat surface 281. The belt 278 is looped over roller gears 282, 284 and 286 to define a generally triangular path of movement for the belt 278. A roller 288 is arranged between the drive rollers 282 and 286 and connected by a pivotal linkage 290 to the bar 258. An auxiliary roller gear 292 is disposed between roller 288 and roller 282. The path of the belt 278 along the base of the triangular path of movement of the belt 278 substantially is parallel to the upper reach of the conveyor 226 and thusly substantially is parallel to the tops of the containers traveling along said reach.

The roller 288 is arranged immediately above the imprinting location within the imprinting zone, this location being where the path 184 circumscribed by the type face of an individual printing head intercepts the concave bottom surface of the container 12. The roller 288 is biased against the inner surface 280 of the belt 278 and functions as a pressure roller to apply a force against the belt at that location and hold the container firmly during the application of the imprint to the concave bottom surface thereof.

The roller gears 280 and 282 are positioned so that the outer surface 182 of belt 278 is one-sixteenth of an inch higher at opposite ends of its linear path along the base of the triangular path of movement of said belt than below pressure roller 288.

An auxiliary roller 292 can be provided to continue the pressure applied to the belt, and thereby to the containers while they are still within the imprinting zone, but as they are passed from the imprinting location along the conveyor to the delivery or discharge end of the machine 10, indicated by reference character 294 in FIG. 1. In this manner, chances of backup of containers at the discharge end 294 of machine 10 is materially reduced so as to avoid damage to the containers and spillage of their contents, say if they would fracture by contact with the blade of the rotating screw member of the worm feed means.

An L-bracket 296 is secured to the undersurface of plate 266 to support bracket 298 through which is journaled the threaded upper end of the stop 218 which limits the upper thrust of the inking and imprinting assembly 50. A hand wheel 300 is connected to the upper end of stop 218 for selectively rotating same to raise or lower stop 218. Accordingly, fine adjustment can be made to the operating level of the inking and imprinting assembly 50 so that the type font 182 of printing heads 176 intercept and engage the bottom surface of the container properly to apply a clear and distinct imprint thereupon.

Attention will be directed now to the drive means and train for operating the various operating components of machine 10. All operating components of the machine 10, including the inking and imprinting assembly, the conveyor means, the worm feed means, and the hold-down assembly are driven from a single source of power 1½ HSP. electric motor 304 carried by support plate 302 which is secured to the plate 32. The motor 304 is coupled to driving gear 306 by way of a Vickers type safety clutch 308 and sprocket chain 310. Gear 312, which is substantially identical to gear 306 is driven by gear 310. Gear 312 is coupled to drive gear 224 carried by shaft 220, by sprocket chain 314 looped over said gears 312, 224 and idler gear 316. Gear 306 also drives sprocket gear 318, is mounted on the same shaft as gears 306 and 312 and is driven simultaneously with such gears by sprocket chain 310 looped thereabout. A gear box 320 is mounted to the framework 14 and contains the gear assembly (not shown) for operating the worm feed means, through the right angle drive means 321.

Gear box 320 carries an input gear 322 coupled to gear 318 by sprocket chain 324 looped thereabout. The drive gear 224 has a companion gear (not shown) which is coupled to gear 332 by chain 334 looped thereabout. Gear 332 also operates conjointly a companion gear which is rotatable therewith and is coupled to the principal drive gear 336 which drives roller 382 and companion rollers 284 and 280 of the hold-down assembly. Idler gears 338 and 340 complete the drive with the sprocket chain 334 for operating the hold-down assembly 256.

Chain 344 is looped about drive gear 224 and gear 132 to rotate the inking wheel 58 and simultaneously drive gear 130. Chain 346 is looped about gears 130, 136 and 186 to drive the transfer wheel 58 and the printing wheel 60. Gear 350 serves as a tension control for the sprocket chain 346. Gear 138 rotates with gear 136 and is coupled to the input gear 190 of the reduction gear assembly 188 by chain 352 looped thereabout.

The speed of travel of the belt 278 is the same as the speed of travel of the conveyor means so as positively to position the container to be imprinted at the imprinting location and to cause the container to hold that position during imprinting so that proper register is obtained.

In accordance with the invention herein, it is essential that the circumferential speed of rotation of the inking wheel, the transfer wheel and the printing wheel be slightly different one relative to the other. This can be accomplished by varying the number of teeth carried by the respective gears 130, 136 and 186. In this manner, with the circumferential speeds of the respective wheels being different, the point at which the circumferential surfaces touch, which has been referred to as the kiss, is incrementally changed after each full rotation of the wheel during the operation of the inking and imprinting assembly. The applicator 74 lays a dab of ink on the circumferential surface of the inking ring at a location thereupon that is incrementally advanced or retarded upon each revolution of said inking wheel so that each dab of ink is applied successively at a different location. This affords a better distribution of ink on the said surface of said ring.

Likewise, the point at which the transfer of ink is made from the inking wheel 56 to the transfer wheel 58 is incrementally advanced or retarded to assure a better distribution of ink over the ink absorbant circumferential surface of the ring carried by the transfer wheel 58. The contact of said circumferential surfaces effects a wiping action and this is most evident with the engagement of the transfer wheel 58 upon each of the type font 182 of the printing heads 176 carried by the printing wheel 60. This wiping action assures an even coat or film of ink is applied to the type face whereby to avoid smearing and provide a good readable and clean imprint upon the container. Excess ink application is avoided.

The worm feed means 252 can be adjusted to maintain proper registration of the imprints at proper location upon the containers by means of a running register control, preferably operated from the front of the machine 10. Hand wheel 352 (FIG. 13) is rotated clockwise or counter clockwise as desired, to advance or to retard pitch of the worm feed screw 254, whereby to change the point at which the interception of the container by the leading edge of said screw is effected and the position at which the last flight of the screw 254 is registered with the imprinting location. The hand wheel 352 is secured to a shaft 354 journaled for rotation in bearing 356 and carries bevel gear 358 which is in right angle engagement with bevel gear 360. Gear 360 is coupled to the gear box 320 and operates to advance or retard the pitch of the screw 254 while the screw continues to rotate. This adjustment of the "last flight" position, advances or retards the relationship of each container to the printing head 126. The screw 254 is rotated at the same R.P.M. as the speed in cans per minute — 1 R.P.M. = 1 can per minute.

The reduction gear assembly 188 preferably is one identified as a "Zero Max Model E-2 With Screw Control" and is available commercially. It should also be pointed out that in the embodiment described, gear 130 is provided with twenty teeth, gear 136 is provided with nineteen teeth, and gear 186 is provided with eighteen teeth. The input and output gears 190 and 192 of the reduction gear assembly 188 are provided with twelve teeth as are gears 70 and 138. The driving gear 224 is provided with eighteen teeth.

The inking and transfer wheels 56 and 58 are formed of aluminum and accommodate frictional engagement of inking rings of 6⅝ inches in diameter by one-half inch wide.

Reference now is made to FIGS. 14 through 18 wherein there is illustrated the invention herein as embodied in a high speed bottle cap coding machine 400. The bottle cap coding machine 400 is supported upon a structural framework capable of being installed for operation upon a pre-existing conveyor train designated generally by reference character 402. The framework includes vertically arranged standards 404 at the input end 406 of the machine 10 and standards 408 at the delivery end of the machine. The standards 404 and 408 serve as legs for supporting machine 10, the lower ends thereof resting upon suitable blocks which may or may not require leveling means (not shown). Crossbars 412 and 414 bridge the vertical standards 404 and 408 respectively and are secured thereto by clamping blocks 416. Second pair of standards 418 and 420 are mounted to clamping blocks 422, and form the upper framework which supports the operating mechanisms of the machine 10. The upper end of the framework carries an upper frame 424 formed of framing members 426 and end supports 428. Suitable bracing such as crossbrace 430 is secured in suitable blocks across the open top of the enclosure defined by the upper framework. A motor support plate 432 is mounted in bridging relationship to the standards 408 and serves to support the electric motor 434, which is an AC-DC variable speed motor whose speed is synchronized to the speed of the pre-existing conveyor.

A crossplate 436 is mounted by clamping brackets 438 slidably on standards 418. The plate 436 carries the imprinting assembly as a unit. Accordingly, the printing assembly can be positioned at variable heights relative to the conveyor simply by the adjustment of the clamps 438 along the support standards 418.

An imprinting assembly 440 is supported on a pair of parallel plates 442 and 444. The plates 442 and 444 are bridged by shafts 446, 448, 450, 452, 454, 456, 458, 460 and 462. The aforesaid shafts are journaled in suitable bearing means (not specifically illustrated). Each of the aforesaid shafts carry gears functioning as the drive for the imprinting apparatus. The unit 440 is mounted to shaft 446 so that it is pivotable thereabout. The shaft 462 bridges the pair of plates 442 and 444 at the corner 464 which is substantially spaced from shaft 446. The shaft 462 supports a block or bar 466 in which a threaded shaft 468 is received. The opposite or upper end of shaft 468 is passed through brace bar 470 and carries a collar 472 mounting a hand wheel 474. Rotation of the hand wheel in one direction causes the unit 440 to pivot about shaft 446 in a direction indicated by arrow 476. Rotation of the wheel 474 in the opposite direction, of course, will lower the assembly 440 as a unit. In this manner, fine adjustments in the positioning of the path of travel of the printing heads can be achieved. This raising and lowering can be performed while the machine is in operation.

The imprinting assembly 440 includes an inking wheel 480, at least one ink transfer wheel 482 and a printing wheel 484. Each of said wheels 480, 482, 484 are mounted upon shafts 452, 454 and 458 respectively with the gears carried by said shafts being disposed between the plates 442 and 444 and the train, wheels 480, 482, and 484, located on the outside of plate 442. Applicator assembly 486 is also carried by plate 442 and consists of an ink bath 488 supplied by bottle feed 490 and an applicator arm 492 which is mounted to hub 494 carried by shaft 450. The inking wheel 480 and the transfer wheel 482 are identical to the similar functioning elements described with respect to the can coding machine 10. The printing wheel 484 on the other hand differs from the printing wheel 60 of the can coding machine 10. The printing wheel 484 comprises a pair of outer discs 494 which, with a pair of inner disks 496, form sandwiches with spacer discs 498. Spacers 498 have a lesser diameter than the discs 496 thereby to define an annular track 497. Rings 499 of generally rectangular cross section and formed of resilient material are seated in track 497. The two sandwiches in turn sandwich a spacer disc 500 of the same diameter as discs 498 to define a track 501. One of the inner discs 496 has annular ring 503 spaced inwardly of its circumferential edge. The ring 503 thus defines a key or retainer for seating type font 502 within rack 501. The thickness of the resilient ring 499 is selected so that the outer circumferential surface of said ring 499 extends outwardly further than the font 502. Said outer circmferential surfaces of rings 499 thus serve to stabilize the bottles 504 during the application of an inprint thereupon by the type face 502. The resilient rings 499 also operate to protect the type to provide a firm surface for rolling and also to compensate for minor variations in height experienced in the series of bottles being treated. Five sets or heads of font are carried by wheel 484.

A plate or similar support (not shown) is provided across plates 422 and 444 to support a reduction gear assembly 508 which carries an input gear 510 and an output gear 512. The reduction gear assembly 508 is identical to the assembly 188 of the can coding machine and also includes a threaded wheel adjustment 514 to control the output delivery of the reduction gear assembly from zero to its maximum 150 RPM. Accordingly, the train consisting of wheels 480, 482 and 484 is driven off the main drive at a speed of 150 RPM and the applicator arm 492 can be rotated at any speed between zero and 150 RPM, the speed at which 750 imprints per minute are achieved.

Gear 509 drives the applicator and is linked to the output gear 512 of reduction gear assembly 508 by sprocket chain 511 looped thereabout.

The output of motor 434 is coupled through a Vickers slip clutch 516 to output gear 518. The main drive for the printing apparatus 440 comprises gear 520 which is mounted to the shaft 446. Gear 522 is coupled to the input 510 of the reduction gear assembly and also is carried by shaft 446 as is the gear 524 which drives the worm feed means to be described hereinafter. Idler gear 526 is used to maintain the tension on drive chain 528 which couples gear 522 to the input gear 510 of the reduction gear assembly 508. Gear 530 drives the inking wheel 480, gear 532 drives the transfer wheel 482 and gear 534 drives the printing wheel 484. Idler gears 536 and 538 are provided to control the tension applied to the drive chain 540 which is looped about the respective gears in the drive train formed by gears 520, 530, 532, 534 and the idlers 436 and 438. The inking wheel 480 is driven counterclockwise in the direction indicated by arrow 542. The transfer wheel 482 is driven in a clockwise direction indicated by arrow 544 and the printing wheel 484 is driven in a counterclockwise direction indicated by arrow 546. The circumferential paths of the inking wheel, transfer wheel and printing wheel are represented by reference characters 548, 550, and 552 and the wheels are arranged so that these paths intercept tangentially at kisses 554 and 556.

The circumferential rotational speed of the inking wheel 480, the ink transfer wheel 482 and the printing wheel 484 are different by selective providing differing numbers of teeth on the gears 530, 532, and 534. In the embodiment illustrated in the Figures, the gear 530 which drives the inking wheel is provided with nineteen teeth. The gear 532 which drives the transfer wheel 482 is provided with eighteen teeth, and the gear 534 which drives the printing wheel 484 is provided with twenty teeth. Accordingly, the kiss 554 incrementally is moved along the circumferential surfaces of the inking and transfer wheels 480 and 482 and the type faces 502 which meet with the transfer wheel 482 at kiss 556, meet in a wiping action so as to result in an even application of ink to the surface, avoiding excess at any place along the type face. Both the inking wheel and the transfer wheel carry inking rings of the aforementioned patent application.

The bottles 560 to be coded are carried by the conveyor assembly 402 and are guided along elevational portions thereof by a pair of rails 562 and 564 mounted on clamp brackets 566 and 568 coupled to one of the vertical standards 418. The bottles are spaced as they travel along the conveyor by worm feed means 570. The worm feed means 570 consist primarily of a driven screw 572 having axial end shafts 574 seated in angled slots 576 which are formed in support plates 578 mounted to vertical support 418 and 420 by clamp member 580. Pins 582 are employed to fix the shaft ends 574 within the slots 576. One of the axial shafts 574 carries gear 584 which is coupled to gear 586 which is driven through gear 588 and chain 590 to a right-angled drive 592, coupled by drive chain 594 to the gear 524 so that the worm 572 is rotated at the same speed at which the printing apparatus 440 is driven and is synchronized with the conveyor speed. The worm 572 can be easily removed and replaced, say with another, perhaps different bottle size screw simply unscrewing pin 582 and withdrawing the axial shaft ends 574 through the opening of angled slot 576. This can be performed without any disassembly of the worm drive. The end of the worm 572 opposite gear 524 can carry a gear (not shown) so that the worm 572, for example, or a substitute worm can be driven from either end thereof.

What is claimed is:

1. A method for the high-speed application of printing code indicia consecutively upon individual articles moving in a line along the upper reach of a conveyor to an imprinting zone arranged along a path of the conveyor, the imprinting being performed by plural printing heads carried by an imprinting wheel, the printing heads intercepting the article at an imprinting location within the imprinting zone; said method comprising:

spacing the articles uniformly one from the other a predetermined distance as they travel along the conveyor to the imprinting zone, restricting lateral movement of the articles through the imprinting zone, applying a positive force directed downward upon the top of each article at least when the imprint is applied temporarily to immobilize the article at the time the imprint is applied at the imprinting location and controlling the speed of circumferential rotation of the imprinting wheel so that the circumferential speed of rotation thereof is correlated with the speed of the conveyor and the number of printing heads carried by the imprinting wheel.

2. The method according to claim 1 in which the spacing is performed by intercepting each article prior to the imprinting zone and then gradually causing said article to increase in speed until it reaches the speed of travel of the conveyor when arriving at the imprinting zone.

3. The method according to claim 1 in which the spacing is effected by intercepting the article prior to the arrival of the imprinting zone by first slowing each article and retarding its travel along the conveyor, thereafter gradually permitting the article to increase its speed of travel and resume the speed of the conveyor when proper spacing has been effected.

4. The method according to claim 1 wherein the positive force is maintained upon the articles subsequent to imprinting and until the articles each reach a location downstream of the imprinting zone.

5. The method according to claim 4 in which the positive force is applied when the articles have resumed the speed of the conveyor.

6. The method according to claim 1 in which the articles are constrained against lateral movement at the imprinting location.

7. The method according to claim 1 in which the positive force is applied by engaging a biased moving belt upon the tops of the containers at the time the articles have resumed a speed of travel that is the same as the speed of the conveyor and continuing such engagement until the articles have passed through the imprinting zone.

8. The method according to claim 7 in which a greater bias is applied to the article at the imprinting location than is applied prior to or subsequent of said location.

* * * * *

UNITED STATES PATENT AND TRADEMARK OFFICE

CERTIFICATE OF CORRECTION

PATENT NO. : 4,080,896

DATED March 28, 1978

INVENTOR(S) : Allen J. McKay as Executor of Estate of James G. McKay, deceased

It is certified that error appears in the above-identified patent and that said Letters Patent are hereby corrected as shown below:

Column 2, line 40, change "coded" to --coding--;

Column 7, line 43, change "the" to --The--;

Column 12, line 21, change "182" to --281--;

Column 13, line 28, change "other" to --others--;

Column 15, line 42, change "inprint" to --imprint--;

Column 16, line 49, change "member" to --members--;

Column 18, line 1, change "of" to --at--.

Signed and Sealed this

*Sixteenth* Day of *October 1979*

[SEAL]

*Attest:*

RUTH C. MASON
*Attesting Officer*

LUTRELLE F. PARKER
*Acting Commissioner of Patents and Trademarks*